United States Patent [19]

Edlund

[11] 4,424,571

[45] Jan. 3, 1984

[54] RECIPROCATING COMPRESSOR ANALOG

[75] Inventor: Carl E. Edlund, Castroville, Tex.

[73] Assignee: Southern Gas Association, Dallas, Tex.

[21] Appl. No.: 278,391

[22] Filed: Jun. 29, 1981

[51] Int. Cl.[3] ..... G06G 7/48; G06G 7/57

[52] U.S. Cl. ..... 364/806; 364/801; 364/803

[58] Field of Search ..... 364/801, 802, 803, 805, 364/806, 807, 808, 800; 330/278, 279, 291, 129; 328/150, 186; 434/126

[56] References Cited

U.S. PATENT DOCUMENTS

| | | | |
|---|---|---|---|
| 2,936,041 | 5/1960 | Sharp et al. | 181/47 |
| 2,951,638 | 9/1960 | Hughes | 364/803 |
| 2,979,940 | 4/1961 | Damewood et al. | 73/71.4 |
| 2,997,124 | 8/1961 | Damewood et al. | 181/47 |
| 3,506,819 | 4/1970 | Carli et al. | 364/803 |
| 3,970,832 | 7/1976 | Itschner | 364/801 |
| 4,079,334 | 3/1978 | Hamilton | 330/279 |
| 4,215,420 | 7/1980 | Kassakian | 364/802 |
| 4,360,787 | 11/1982 | Galpin | 330/129 |

FOREIGN PATENT DOCUMENTS

| | | | |
|---|---|---|---|
| 412611 | 11/1974 | U.S.S.R. | 364/806 |
| 476573 | 3/1976 | U.S.S.R. | 364/806 |
| 577544 | 11/1977 | U.S.S.R. | 364/803 |
| 640326 | 12/1978 | U.S.S.R. | 364/802 |
| 802691 | 2/1981 | U.S.S.R. | 364/803 |

OTHER PUBLICATIONS

"An Interactive Compressor Simulator" by Blankespoor et al., Proceedings of the 8th AICA Congress at Delft, Netherlands, 23–28, Aug. 1976, pp. 897–906.

*Primary Examiner*—Mark E. Nusbaum
*Assistant Examiner*—William G. Niessen
*Attorney, Agent, or Firm*—Hubbard, Thurman, Turner & Tucker

[57] ABSTRACT

An apparatus for electrically simulating a reciprocating gas pump or compressor includes unidirectional devices for simulating intake and discharge valves. The volume of the reciprocating cylinder is modeled by a fixed capacitor coupled in a feedback arrangement with a variable gain amplifier. The gain of the amplifier is preferably controlled by the contents of a digital memory device, which varies the gain to simulate the pumping action of a compressor. The device provides voltage outputs representing the pressure and volume readings obtained in the compressor being simulated.

3 Claims, 4 Drawing Figures

RECIPROCATING COMPRESSOR ANALOG

BACKGROUND OF THE INVENTION

The present invention relates generally to devices for electrically simulating compressors and pumps, and more specifically to a device for simulating the variable volume and pumping action of a reciprocating compressor or pump.

Installation or modification of natural gas or other fluid distribution systems requires consideration of a number of factors before work is undertaken. Variations in loads, distribution paths, pipe sizes and compressor speeds all have effects on the operation of the system as a whole. Compression waves created in the gas by the operation of reciprocating pumps and compressors are especially troublesome, as fluid acoustic resonances can be set up in the system. These resonances increase metal fatigue and shorten the life of joints, valves and other components of the system.

To assist in planning for control of pulsations and vibrations, an electrical analog of all fluid components can be created. Present electrical systems analogize current to mass flow of the gas and voltage to pressure. Inductors, capacitors and resistors are used to model the acoustical properties of pipes and other components in the distribution system. A detailed model of a distribution system or subsystem can be set up and studied to predict the effects caused by changing various parameters in its operation.

In order to utilize easily obtained components, the operating frequency of the electrical analog is typically substantially higher than that of the mechanical system. An electrical to mechanical frequency ratio is typically in the neighborhood of 1000 to 1. Component valves and analog system parameters are chosen so that all events which occur during the operation of the model reflect events which will take place in a mechanical system. For example, the presence of an electrical resonance in the analog system at a certain frequency corresponds to an acoustical resonance in the mechanical system at the corresponding mechanical speed.

The present state of the art in pumping system analogs is typified by U.S. Pat. No. 2,951,638, issued to Hughes, et al. The system described therein utilizes a model of a reciprocating compressor including a capacitor which is driven by a sinusoidal voltage source. Due to inaccuracies inherent in the use of a fixed capacitor to model the changing volume of a compressor cylinder, the driving voltage signal to the capacitor must be shaped to insure that the electrical model gives accurate results.

Since a fixed capacitance is used to model a time varying volume, it is not possible for the model to present the correct acoustic compliant reactance to both the intake and discharge ports of the model when the respective valves are opened to the remainder of the circuit. The volume of the mechanical cylinder is at or near a mimimum value during the discharge cycle, and at or near a maximum value during the intake cycle. Thus, it is at best possible to only approximate the proper impedance to either the intake or discharge port of the model cylinder, with the impedance at the other port differing substantially from the correct value.

Further, it is necessary that the correct current, analogous to mass flow of the gas, be transported through the cylinder analog on each cycle. In order to meet this criteria, it is frequently impossible to present the proper cylinder impedance to either the intake or discharge port.

In practice, it is necessary to arbitrarily choose a capacitance which lies somewhere in the range between the minimum and maximum values presented to the cylinder port. The magnitude and shape of the driving signal are then arbitrarily adjusted until the proper pressure-volume diagram is obtained for the particular cylinder being modeled, and the value of the capacitance is then arbitrarily readjusted to obtain the proper analog current flow. The analog models the mechanical compressor only approximately, with a degree of accuracy primarily dependent upon the skill of the model operator. The capacitor can in no sense be considered to correspond to any real physical volume, with the result that the reactance presented by the model cylinder to the rest of the circuit is incorrect.

Additionally, because the driving signal for the electrical model has been arbitrarily shaped, conventional phase meters cannot be used to control the relative phase between several cylinders, which is necessary when modeling a multi-cylinder compressor. Relative phasing between cylinders is thus rendered difficult.

It would be desirable that an electrical analog of a mechanical compressor could provide the correct reactances to the remainder of the circuit, while at the same time giving accurate volumetric efficiency and the correct analogous current flow. It would further be desirable that such an electrical model could be easily and accurately phased with other similar models in order to make an analog of a multicylinder compressor.

SUMMARY OF THE INVENTION

It is therefore an object of the present invention to provide an electrical model of a mechanical reciprocating compressor which continuously presents the correct acoustic reactance to the remainder of a circuit in which it is incorporated.

It is another object of the present invention to provide an electrical model of a mechanical compressor or pump having voltages which are accurately proportional to the pressure and volume curves of the mechanical pump.

It is yet another object of the present invention to provide such an analog having a phase which is easily determined, and which is readily controllable relative to the phase of any other cylinder analogs.

According to the present invention, a capacitor is coupled into the feedback loop of a variable gain voltage amplifier. The gain of the amplifier is controlled by the output of a storage device, which is preferably a digital memory device. The input to the variable gain amplifier is coupled to two unidirectional current devices which model the intake and discharge valves of the mechanical compressor. Outputs are provided from the model which are proportional to the time-varying pressure and volume values of the mechanical cylinder.

The novel features which characterize the present invention are defined by the appended claims. The foregoing and other objects and advantages of the invention will hereinafter appear, and for purposes of illustration, but not of limitation, a preferred embodiment is shown in the accompanying drawings.

DESCRIPTION OF THE PREFERRED EMBODIMENT

Figure 1:
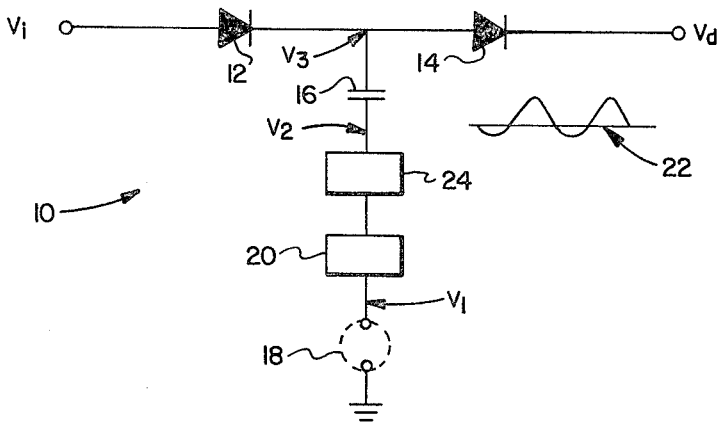
FIG. 1 (PRIOR ART)
FIG. 1 is a schematic diagram of a prior art electrical analog of a reciprocating compressor.

The present invention relates to an improved apparatus for simulating the action of a driven crankshaft, and a piston and cylinder, of a reciprocating compressor or pump. Referring to FIG. 1, a typical prior art circuit 10 for modeling a reciprocating compressor is shown. For a detailed explanation of the manner in which models of this type correspond to mechanical compressors, see for example U.S. Pat. No. 2,951,638.

In this prior art example, two diodes 12, 14 model the action of mechanical intake and discharge valves. An intake voltage $V_i$ and a discharge voltage $V_d$ model the gas pressure in the intake and discharge lines coupled to the mechanical compressor. A capacitor 16 approximately models the volume of the cylinder. The power input to the crankshaft is modeled by a sinusoidal signal $V_1$ produced by a voltage source 18, which can be phase shifted if necessary by a phase shifting circuit 20. Since the volume of the mechanical cylinder is constantly changing, and the value of the capacitor 16 remains fixed, inaccuracies are introduced into the model 10. To compensate for these inaccuracies, it is necessary to change the shape of the crankshaft signal $V_1$ to that shown as 22. This is accomplished in a wave shaping circuit 24. The voltage out of the shaping circuit $V_2$ can be approximately described as a sinusoidal signal having enlarged positive lobes. The precise shape of $V_2$ must be adjusted in the shaping circuit 24 until the model 10 reflects the conditions actually obtained from the mechanical compressor.

The model 10 is a charge pump which transfers charge from a lower voltage $V_i$ to a higher voltage $V_d$. When the shaped voltage $V_2$ is low, current is drawn through the intake diode 12 so that a capacitor voltage $V_3$ is substantially equal to the intake voltage $V_i$. When the shaped driving signal $V_2$ increases, the intake diode 12 ceases to conduct and the capacitor voltage $V_3$ increases at a rate which parallels the shaped driving voltage $V_2$. When the capacitor voltage $V_3$ becomes slightly higher than discharge voltage $V_d$, the discharge 14 diode turns on and conducts current away from the capacitor 16. When the shaped signal $V_2$ begins to fall, the discharge diode 14 ceases to conduct and the capacitor voltage $V_3$ falls at a rate which parallels the shaped driving signal voltage. When the capacitor voltage $V_3$ becomes low enough, the intake diode 12 begins to conduct current, and the cycle is repeated.

Figure 2:
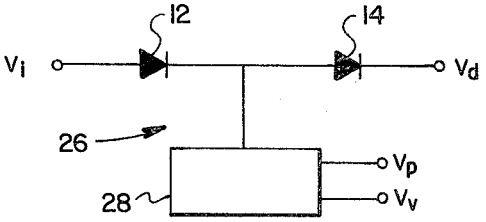
FIG. 2 is a block diagram of an improved electrical analog of a reciprocating compressor according to the present invention.

FIG. 2 shows a block diagram of an improved crankshaft and piston-cylinder analog 26 according to the present invention. Two diodes 12, 14 are used to model the intake and discharge valves 12, 14 in the same manner as the prior art model 10. An improved crankshaft and cylinder model 28 replaces the sinusoidal signal source 18, phase shifting circuitry 20, wave shaping circuitry 24 and capacitor 16 of the prior art model 10. The improved cylinder model 28 also has provision for pressure and volume voltages, $V_p$ and $V_v$, to be supplied as outputs.

The present invention in part synthesizes a variable capacitor which is time controllable by an electrical signal. Such a synthetic capacitor can be used to accurately model the changing volume of a reciprocating cylinder.

Figure 3:
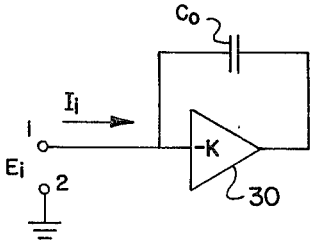
FIG. 3 is a schematic diagram of a circuit for simulating a variable capacitor.

The general method used by the present invention for simulating a variable capacitor is shown in FIG. 3. $E_i$ is the voltage between terminals 1 and 2, while $I_i$ is the current into terminal 1. $C_o$ is a fixed capacitor, and an amplifier 30 is assumed to be an ideal amplifier with a gain of $-K$.

The electrical impedance across terminals 1 and 2 is given by the equation:

$$Z_i = \frac{E_i}{I_i} = \frac{-j}{\omega(1+K)C_o} \tag{1}$$

The impedance of a pure electrical capacitance is given by the equation:

$$Z_c = \frac{-j}{\omega C} \tag{2}$$

A comparison of equations 1 and 2 shows that the complex impedance looking into terminals 1 and 2 of the circuit of FIG. 3 is equivalent to a pure electrical capacitance having a magnitude of:

$$C=(1+K)C_o \tag{3}$$

The preferred embodiment of the present invention is suitable for use with prior art analog systems such as that described in U.S. Pat. No. 2,951,638, issued to Hughes et al., which is herein fully incorporated by reference. Electrical quantities, and relationships between them, which can be used to define the relationship between the analog system and the acoustical properties of mechanical compressors are defined in U.S. Pat. No. 2,951,638 for certain prior art systems. The quantities and relationships are referred to as "design parameters," and are found in U.S. Pat. No. 2,951,638 beginning at column 12.

The present invention utilizes the relationships defined in U.S. Pat. No. 2,951,638. In addition to the parameters shown therein, the symbol "n" is used herein to represent the isentropic compression exponent for a gas at a particular temperature and pressure.

The following two equations from Hughes will be used:

$$\alpha = \frac{P}{V} \tag{4}$$

$$C = \frac{\alpha\gamma}{\beta}\ \frac{A\rho}{B} \tag{5}$$

Additionally:

$$B=nP=n\alpha V \tag{6}$$

Combining equations (4), (5) and (6) gives:

$$C = \frac{\alpha^2\gamma}{\beta}\ \frac{A\rho}{nV} = \frac{K_oA\rho}{nV} \tag{7}$$

$$CVn = K_oA\rho \tag{8}$$

Since current is analogous to mass flow of the fluid, n is dimensionless, and CV=Q(charge), the expression on the righthand side of equation (8) is proportional to fluid mass. In a reciprocating pump, fluid mass taken into the cylinder is equal to that discharged, so that:

$$C_iV_i=K_1C_dV_d=Q \quad (9)$$

where $K_1$ is the ratio of isentropic compression exponents for the discharge and intake conditions. $K_1$ is generally close to 1 for most real situations, but can be as high as approximately 3 or more.

From equation (9) it is seen that for a fixed charge Q, the voltage across capacitor $C_o$ in FIG. 3 is varied by changing the capacitance of $C_o$ as seen from terminal 1. This is accomplished by changing the gain of the amplifier 30. When input terminal 1 of FIG. 3 is coupled between the diodes 12, 14 of FIG. 2, the charge on capacitor $C_o$ is constant when $E_i$ is between $V_i$ and $V_d$. Therefore, with the addition of means for controlling the gain of the amplifier 30, the circuit of FIG. 3 can be substituted into FIG. 2 for the cylinder model 28.

Figure 4:
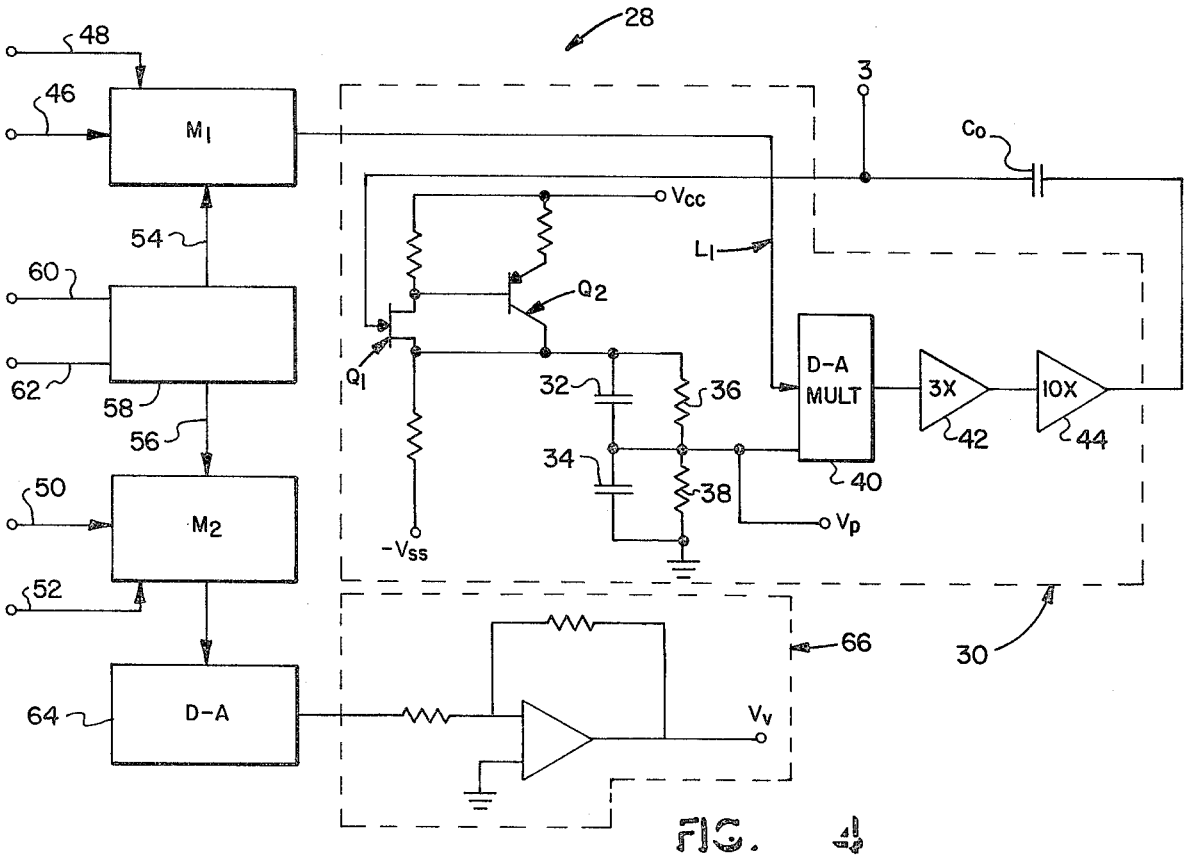
FIG. 4 is a schematic diagram of an improved circuit for simulating the cylinder and crankshaft of a reciprocating compressor.

A preferred embodiment of an apparatus 28 for modeling the crankshaft and cylinder of a reciprocating pump or compressor is shown in FIG. 4. A capacitor $C_o$ is coupled to a controllable gain amplifier 30 in a feedback arrangement. Terminal 3 is coupled to the junction between the diodes 12 and 14 of FIG. 2. A field effect transistor $Q_1$ and a bipolar junction transistor $Q_2$ form a high input impedance unity gain buffer amplifier. Voltages $V_{cc}$ and $-V_{ss}$ form the power supply for $Q_1$ and $Q_2$. Capacitors 32, 34 and resistors 36, 38 form a 3 to 1 attenuator network, so that voltage $V_p$ is one third the value of $E_i$. $V_p$ is coupled to an input of a multiplying digital-analog converter 40. The other input to the converter 40 is an eight bit digital signal derived from memory $M_1$. The output of the DA converter is equal to:

$$\text{output}=V_p(N/256) \quad (10)$$

where N is the numerical value of the binary bit pattern which appears on line L1. N is an integer in the range of 0 to 255, inclusive. The value of N will be changing with time according to information stored in memory $M_1$, so that the output of the multiplier 40 is equal to the analog value of $V_p$ multiplied by the instantaneous value of N/256. Amplifiers 42 and 44 multiply the analog output from the converter by 3 and 10 times respectively, for a total multiplication of 30. Since $V_p$ is $\frac{1}{3}$ of $E_i$, the output voltage of the controllable amplifier 30 is at most approximately 10 times $E_i$.

The gain of the controllable amplifier 30 is actually given by the equation:

$$K=0.0396063(N) \text{ for } 0\ N\ 255 \quad (11)$$

Combining this equation with equation (3) gives:

$$C=C_o(0.0396063(N)+1) \quad (12)$$

Therefore, the impedance at terminal 3 appears as a pure electrical capacitance having an adjustable value which depends on the output from memory M1.

The magnitudes of the scaling factors used in the variable amplifier 30 are not critical, but the values discussed above have been chosen for ease of use with the remainder of the compressor analog circuit.

Data is loaded into memory $M_1$ through an eight bit data input line 46, and a read-write input 48 determines whether data is being loaded into the memory $M_1$, or being read out. A second memory $M_2$ is similarily loaded through an eight bit data entry line 50, and the read or write status of the second memory $M_2$ is determined by a read-write input 52. The address inputs 54, 56 into both memories $M_1$ and $M_2$ are accessed by a binary counter 58, which, in the preferred embodiment, is an eight bit counter. The counter 58 has a reset input 60, and a clock input 62 which causes the counter 58 to sequentially access both memories $M_1$ and $M_2$. The two memories $M_1$ and $M_2$ are inherently synchronized since their data is accessed by the same input signal.

The data output from the second memory $M_2$ is converted to an analog signal in a digital to analog converter 64, the output of which is put through a unity gain amplifier 66. The amplifier output voltage $V_v$ represents the volume within the analog cylinder.

The preferred embodiment utilizes two fast random access memories $M_1$ and $M_2$, but other memory devices such as serial shift registers activated by a common clock signal may also be used.

The data stored in memory $M_2$ represents the time varying volume of the analog cylinder, and will be basically sinusoidal. However, a mechanical compressor or pump usually has a time varying volume which varies by as much as several percent from a true sinusoid, and the data stored in memory M2 can reflect these distortions. Thus, an accurate signal $V_v$ proportional to cylinder volume is obtainable from the device 28.

The data stored in the first memory $M_1$ varies the analog pressure in the cylinder, which is reflected by the changing voltage $E_i$. A mechanical cylinder presents a different acoustic compliance to the remainder of the fluid curcuit during the intake, compression, discharge and expansion portions of the cycle. The data stored in the first memory $M_1$ is obtained from appropriate calculations and reflects these changes. Differences in the constant $K_1$ during different portions of the cycle are also reflected in the data stored in memory $M_1$. Thus, an electrical analog which is accurate in all respects is provided by the present device 28.

The data in both memories can be calculated on a general purpose digital computer (not shown) if desired, and the information entered into the memories $M_1$ and $M_2$ automatically. This greatly simplifies the task of initializing each analog cylinder 28.

The preferred embodiment of the present invention is an apparatus which accurately models the action of a reciprocating cylinder. The voltage outputs $V_p$ and $V_v$ reflect the correct pressure and volume information for the analog cylinder. The phasing of the cylinder 28 operation is accurately controlled by presetting the counter 58 to a desired value. This allows a plurality of such cylinder analogs to be accurately phased in relation to each other by presetting the counter for each cylinder to the desired value. All cylinders are operated from a common clock signal, thus eliminating phasing problems encountered in prior art analogs.

While the specification and claims refer to compressors and pumps, and intake and discharge valves, etc., it is understood that these terms are intended to include the use of this invention to simulate internal combustion engines with their intake and exhaust valves, etc., and other acoustic wave generators and systems analogous to gas compressors and systems employing same.

Although a preferred embodiment has been described in detail, it is understood that various substitutions, alterations, and modifications may become apparent to those skilled in the art. These changes may be made without departing from the spirit and scope of the invention as defined by the appended claims.

What is claimed is:

1. An apparatus for electrically simulating a reciprocating fluid compressor, comprising:

means for simulating a compressor intake valve;

means for simulating a compressor discharge valve, wherein said discharge valve simulating means is coupled to said intake valve simulating means at a common point;

a high impedance buffer amplifier having an input coupled to the common point and an output;

a first memory;

a multiplier coupled to the buffer amplifier output and a first memory output, wherein said multiplier has an output proportional to the product of the buffer amplifier output and the first memory output;

a capacitor coupled to the output of said multiplier and to the input of said buffer amplifier in a feed back arrangement;

a second memory;

means coupled to said first and second memories for sequentially addressing their contents;

means coupled to said second memory for converting an output to an analog signal proportional to the volume of the reciprocating compressor; and an output line coupled to the output of said buffer amplifier, wherein the voltage present on said output line is proportional to the fluid pressure in the compressor.

2. The apparatus of claim 1, wherein said valve simulating means comprises two diodes.

3. An apparatus for electrically simulating a reciprocating fluid compressor, comprising:

means for simulating an intake valve;

means for simulating a discharge valve, wherein said discharge valve simulating means is coupled to said intake valve simulating means at a common point;

a controllable gain amplifier having an input coupled to the common point;

a capacitor coupled to an output and the input of said amplifier in a feedback arrangement;

a first memory;

means contained within said amplifier for multiplying an output signal from said first memory with a voltage proportional to the voltage present at the input of said amplifier;

a second memory;

a digital to analog converter coupled to the output of said second memory; and means for sequentially addressing the contents of said first and second memories.

* * * * *

UNITED STATES PATENT AND TRADEMARK OFFICE

CERTIFICATE OF CORRECTION

PATENT NO. : 4,424,571

DATED : January 3, 1984

INVENTOR(S) : Carl E. Edlund

It is certified that error appears in the above-identified patent and that said Letters Patent is hereby corrected as shown below:

Column 4, line 65, "$C = \frac{a^2y}{B} \quad \frac{Ap}{nV}$" should be --$C = \frac{a^2y}{B} \cdot \frac{Ap}{nV}$--.

Signed and Sealed this

Fourth Day of December 1984

[SEAL]

*Attest:*

GERALD J. MOSSINGHOFF

*Attesting Officer*

*Commissioner of Patents and Trademarks*